US006313814B1

(12) United States Patent
Arimoto et al.

(10) Patent No.: US 6,313,814 B1
(45) Date of Patent: Nov. 6, 2001

(54) DISPLAY CONTROL CIRCUIT FOR DISPLAY PANEL

(75) Inventors: Hironobu Arimoto; Atsushi Ito, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/261,222

(22) Filed: Mar. 3, 1999

(30) Foreign Application Priority Data

Sep. 30, 1998 (JP) ..... 10-276982

(51) Int. Cl.[7] ..... G09G 3/28
(52) U.S. Cl. ..... 345/63; 345/60; 315/169.1
(58) Field of Search ..... 345/60, 63, 55, 345/67–68, 204, 89; 315/169.1, 169.3, 169.4

(56) References Cited

U.S. PATENT DOCUMENTS

| | | | | |
|---|---|---|---|---|
| 5,745,085 | | 4/1998 | Tomio et al. | 345/63 |
| 6,002,381 | * | 12/1999 | Tomio et al. | 345/60 |
| 6,023,258 | * | 2/2000 | Kuriyama et al. | 345/60 |
| 6,052,105 | * | 4/2000 | Yamamoto et al. | 345/94 |
| 6,100,859 | * | 8/2000 | Kuriyama et al. | 345/60 |
| 6,249,265 | * | 6/2001 | Tajima et al. | 345/63 |

FOREIGN PATENT DOCUMENTS

| | | | |
|---|---|---|---|
| 0653740 | | 5/1995 | (EP) . |
| 0755043 | | 1/1997 | (EP) . |
| 5273939 | | 10/1993 | (JP) . |
| 6-348227 A | * | 12/1994 | (JP) . |
| 9-68945 A | * | 3/1997 | (JP) . |
| 9-185343 A | * | 7/1997 | (JP) . |
| 1026959 | | 1/1998 | (JP) . |
| 97-17861 A | * | 4/1997 | (KR) . |

* cited by examiner

*Primary Examiner*—Richard Hjerpe
*Assistant Examiner*—Francis Nguyen
(74) *Attorney, Agent, or Firm*—Rothwell, Figg, Ernst & Manbeck

(57) ABSTRACT

For image data of each display cell, correction is performed with data from a correction memory and stored in an image memory. A sequencer sends a signal regarding a display pulse within one frame to a sequence counter, which the sequence counter counts. A value corresponding to the count value is read out from a look up table, and a comparator compares the image data for one display cell from the image memory with a value (number of discharges or value corresponding to brightness) regarding the display pulse converted from the lookup table. When the value from the lookup table reaches the value of the image data, the display data is changed so as to control the state of discharge (such as to stop the discharge). The number of discharges corresponding to the image data is controlled by the contents of the lookup table so that the brightness can be controlled and correction is easily performed.

5 Claims, 12 Drawing Sheets

DISPLAY CONTROL CIRCUIT FOR DISPLAY PANEL

BACKGROUND OF THE INVENTION

1. Field of the Invention

This invention relates to a drive circuit for a display panel, disposed with a common electrode and an individual electrode in each of a plurality of display cells arranged in a matrix configuration, for controlling gas discharges in each display cell by applying display pulses to the common electrode to perform display operations and by individually applying control voltages to individual electrodes to control the discharge in each display cell.

2. Description of the Related Art

Heretofore, display panels, such as plasma displays, are known for performing display operations by controlling the gas discharge of every display cell. These types of display panels are formed by disposing display cells into many matrix configurations for individually performing gas discharges.

Usually, the discharges are performed in pulses and the number of discharges in one frame in each display cell is controlled by luminance information regarding the respective display cell. For example, through the luminance data that is input, the number of discharges is set to a maximum number when the luminance of the display cell is at maximum luminance, and the number of discharges is set to 0 at minimum luminance. Furthermore, one set of three types of RGB display cells form one pixel, and the driving of each display cell is controlled by individual RGB luminance data for one pixel.

When actually performing a display operation in the display panel, it is necessary to perform various types of correction, such as adjustment of tint or gamma correction for the luminance data. These types of correction were performed for luminance data in the same manner as the correction of ordinary image data.

The data processing for these types of correction usually use the same calculations. However, if a setting is to be changed, the calculation must also be changed. This change is difficult to accomplish if an attempt is made to implement the circuit in hardware. On the other hand, if the circuit is implemented in software, a lot of time is required and the load on the processor increases.

SUMMARY OF THE INVENTION

The object of this invention is to provide a display control circuit for a display panel that has simple circuitry using a lookup table and that performs high-speed processing.

The drive circuit for a display panel concerned with in this invention comprises a sequence counter for counting the number of display pulses to be supplied to the common electrode, a lookup table for outputting an assumed luminance value corresponding to and addressed by the count value of the sequence counter, and a comparator for comparing the assumed luminance data from the lookup table with luminance data that is input. An output of the comparator controls a period of applying control voltage to the individual electrode of one display cell. According to this apparatus, discharges can be controlled to occur or not occur by a control voltage to the individual electrode corresponding to a display pulse. Therefore, controlling the time of applying the control voltage to the individual electrode enables the number of discharges to be controlled and enables the luminance in the display cell to be controlled.

Rewriting the contents of the lookup table enables the time of applying the control voltage to the individual electrode to be made to correspond to luminance data that is input so that the number of discharges can be controlled. Namely, the display becomes brighter with a larger number of discharges, so that by handling the data in the lookup table, the number of discharges, which changes with single units (one step) of luminance data, can be varied when the luminance data is small or when it is large. Therefore, various types of corrections, such as gamma correction, can be performed using the contents of the lookup table, using the lookup table in this manner can speed up calculations and facilitate changes in characteristics. Having separate lookup tables to correspond with the RGB colors enables the individual brightness of the respective RGB color to be adjusted and also enables tint adjustments.

It is preferable for the above-mentioned lookup table to store differential data and to sequentially add the differential data that is output on the basis of the count value of the sequence counter so as to yield an assumed luminance value. This enables the same calculations to be performed with a narrower bit width of the lookup table.

It is also preferable to have a correction data table for storing correction data for each display cell so that the correction data corresponding to luminance data for each display cell that is input is read out from the correction data table for correction and the corrected luminance data is supplied to a comparator. This enables the adjustment of every display cell to be performed on the image data according to the correction data table, and the lookup table can store data for all display cells.

This invention is composed as described above and achieves the effects given below.

(i) The luminance of the display panel corresponding to the input luminance data is set by reading out the assumed luminance value from the lookup table according to the count value corresponding to the number of discharges, and by comparing this assumed luminance value with the luminance data that is input. Thus, the luminance in the display cell corresponding to the luminance data that is input can be changed by rewriting the contents of the lookup table.

(ii) The same calculations can be performed with a narrower bit width of the above-mentioned lookup table by storing differential data into the lookup table.

(iii) By providing a correction data table for storing correction data for each display cell and by performing correction for the luminance data of each display cell that is input, the adjustment of every display cell can be performed on the image data according to the correction data table, and for using the lookup table, it does not matter to which display cell the data corresponds.

DETAILED DESCRIPTION OF THE PREFERRED EMBODIMENTS

Figure 1:
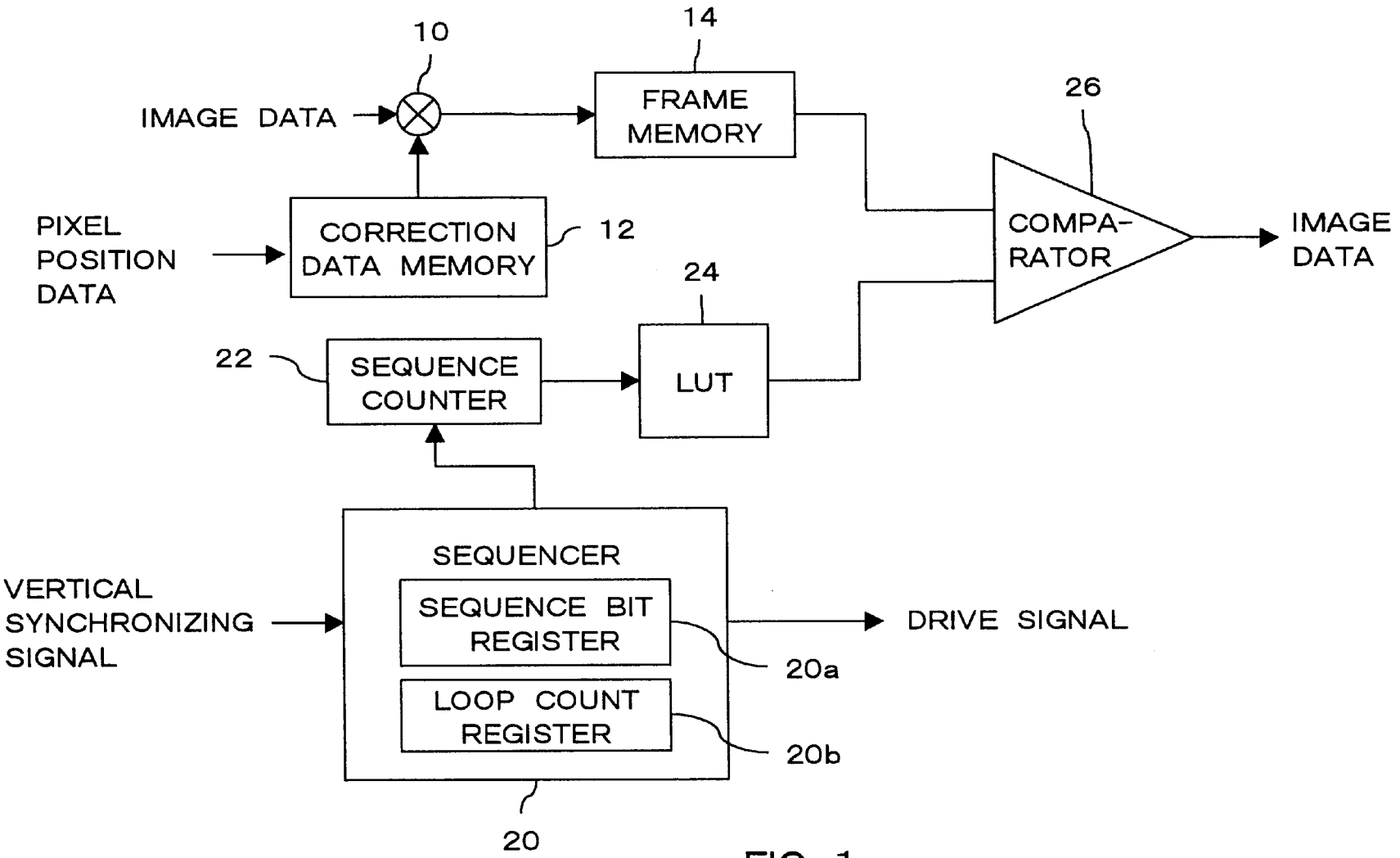
FIG. 1 is a block diagram showing a structure of one embodiment of this invention.

One embodiment of this invention will be described hereinafter with reference to the attached drawings. FIG. 1 is a block diagram showing a structure of a display control circuit for a display panel of the embodiment.

Image data, which is RGB digital data for every pixel, is input by a multiplier 10. In the display panel, one pixel comprises three RGB display cells. One RGB data item at a time causes the discharge of the corresponding display cell to be controlled. The description below is based on the case where a single luminance data is input.

Correction data is supplied to the multiplier 10 from a correction memory 12, and correction is performed from the multiplication of the image data and correction data. The correction memory 12 stores correction data for every display cell. The correction data corresponding to the image data is read from the correction memory 12 and multiplied on the basis of the image position data that is input to yield error-corrected image data for every cell. This allows variations in luminance of the display cells to be corrected. It should be noted that the corrections need not necessarily be performed by multiplication but may be performed by the addition of differential data. In this embodiment, the image data has 9 bits and the correction data has 8 bits. With a "1" added to the most significant bit of the correction data for a total of 9 bits, 9×9 multiplication is performed and the most significant 9 bits are output from the multiplier 10 as the calculation result.

The corrected image data, which is the output of the multiplier 10, is stored in an image memory 14. The image data for at least one frame is stored in the image memory 14. Usually, the image data for one frame at a time is stored for R, G, and B, respectively.

In the meantime, a sequencer 20 generates and outputs a drive signal for common electrode drive after detecting the start of one frame with a vertical synchronizing signal. The display pulse is repeated in periods of one frame and supplied to the common electrode. The sequencer 20 then supplies a pulse signal, which is synchronized to the display pulse, to a sequence counter 22. Thus, a count value in the sequence counter 22 is determined by the number of display pulse outputs. The luminance of the display cell corresponds to the number of discharges in one frame. Since the number of discharges corresponds to the number of display pulses, the count value becomes the assumed luminance (assumed luminance data) when light is emitted due to the display pulses.

The output of the sequence counter 22 is supplied to a lookup table (LUT) 24. A predetermined conversion is performed according to this lookup table 24 and the converted assumed luminance data is input by a comparator 26. The image data from the image memory 14 is input to another input terminal of this comparator 26. A one-bit signal is then obtained from the comparator 26 in order to control the supply of the control voltage to the individual electrode of the display cell.

One data item is output from the lookup table 24 for each display cell in the display of one frame display. For a color display, there are three types of RGB data for one display unit (pixel: three types (RGB) of data for one pixel) so the image data for one frame (three types of RGB data for three frame memories) is output in parallel from the image memory 14. The comparator 26 is provided for each color, and at each comparator 26, the image data for each display cell and the assumed luminance data from the lookup table 24 are compared. The comparison results are individually output from the comparators 26 one by one as display data of each display cell. Controlling the voltage applied to each individual electrode of each display cell by one frame of pixels×3 (RGB) items of display data controls the light emission in each display cell so that a display on the display panel is performed.

For example, if the image data has 256 gradations and the number of pulses to be output from the sequencer 20 is 256 pulses, it is sufficient to cause the display cell to emit light by performing the discharge according to the display pulses until the output value of the sequence counter 22 is the same as the gradations of the image data. When the values that are input are identical at the comparator 26, it is sufficient to change the value of the display data and at this time to control the control voltage to be applied to the individual electrode so that the light emission ceases. In this embodiment, an arbitrary conversion can be performed for the assumed luminance data by means of the contents of the lookup table 24. Therefore, the light emission time can be set as desired in accordance with the gradations of the image data.

In this embodiment, the number of display pulse outputs in one frame is 765 pulses. If the lookup table 24 is set so that 0, 3, 6, 9, . . . , 765 are output with respect to inputs 0, 1, 2, 3, . . . , 255, one gradation corresponds to three discharges and both the input and output have a linear relationship.

Figure 2:
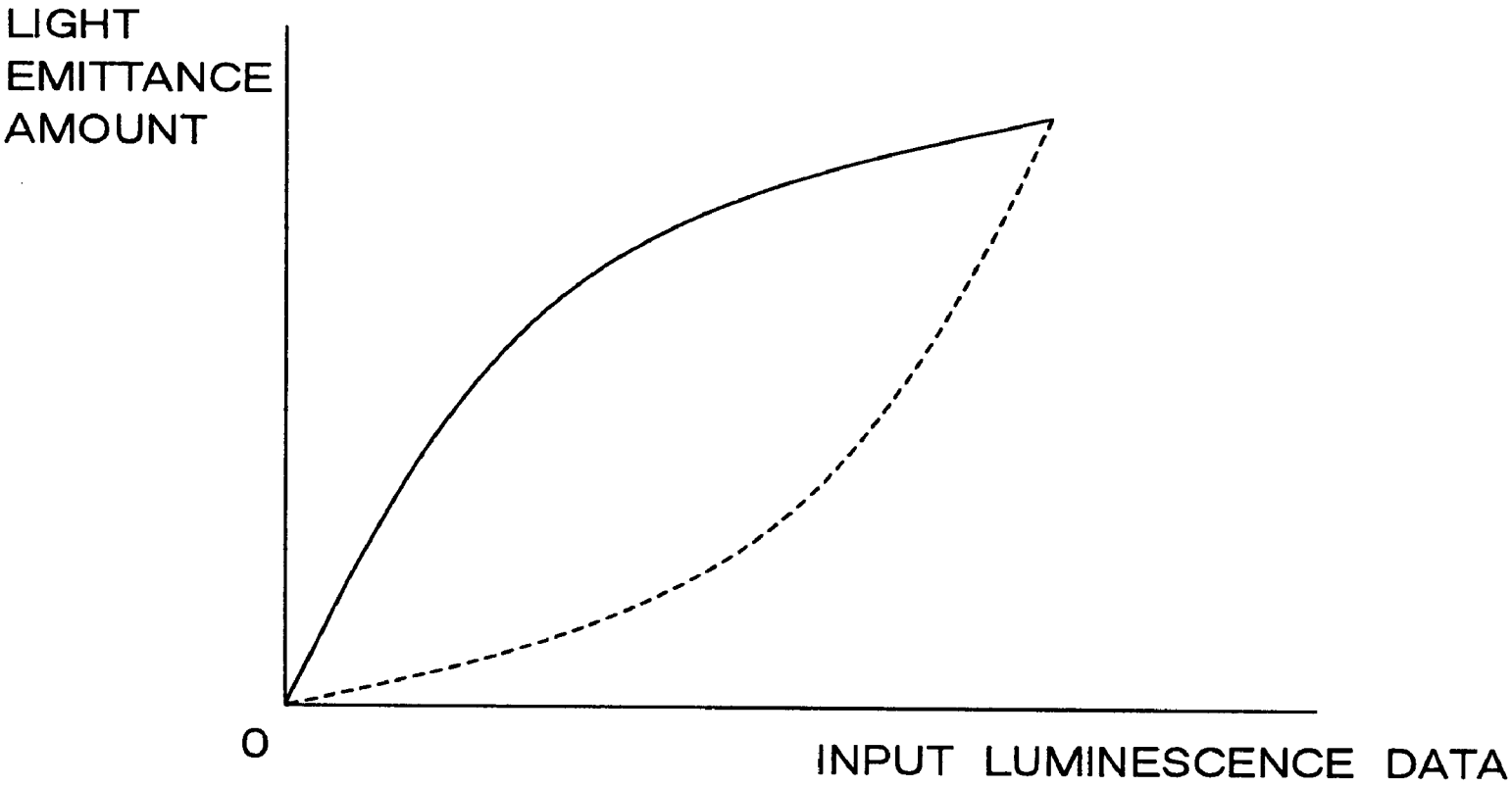
FIG. 2 shows the correction of light emission amount.

In the meantime, if the amount of the increment or decrement is varied, such as if the value of the lookup table 24 is initially incremented by 1 and subsequently incremented by 5, the amount of light emission can be arbitrarily set according to the change in gradation as shown by the solid and broken lines in FIG. 2.

Thus, gamma correction can be achieved through the settings of the contents of the lookup table 24. Furthermore, through each of the RGB colors, the tint and so forth can be set by rewriting the contents of the lookup table 24.

By making it possible to rewrite the lookup table 24 in this manner, arbitrary characteristics can be set.

Figure 3:
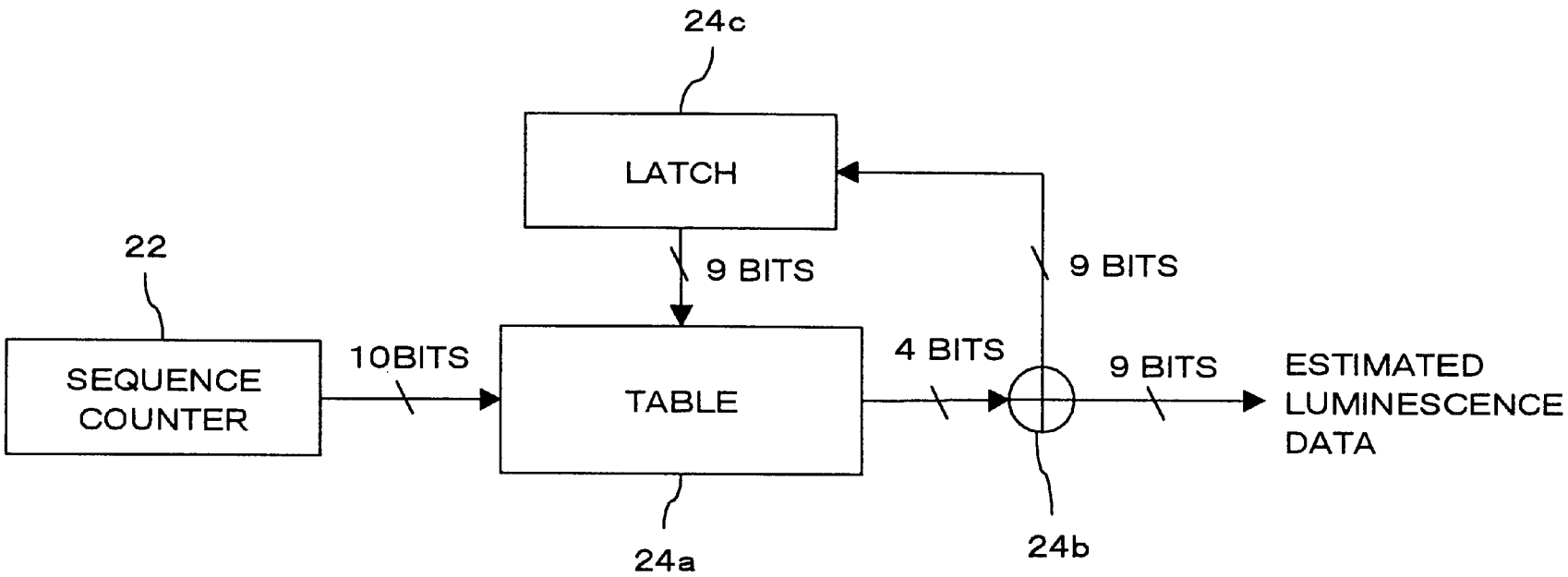
FIG. 3 shows a structure of a lookup table.

FIG. 3 shows an example of a structure of the lookup table 24. As shown, a 10-bit count value is supplied from the sequence counter 22. A table 24*a* has an organization of 4-bit×1024 (although 765 is suitable if the maximum number of output display pulses is 765 as described above, 1024 is adopted since addressing is done with a 10-bit count value) and stores differential data for values to realize the characteristics shown in FIG. 2.

The output of the table 24*a* is supplied to an adder 24*b*. To this adder 24*b* is supplied data from a latch 24*c* and addition is performed. The output of the adder 24*b* is latched by the latch 24*c*. Therefore, the adder 24*b* sequentially adds its own previous output to the differential data from the table 24*a*, and an estimated value of the differential data is output from the adder 24*b*.

This sort of configuration enables 9-bit data to be output from the adder 24*b* with the table 24*a* having a 4-bit width. Therefore, the lookup table 24 can be small since 9-bit data need not be stored.

Figure 4:
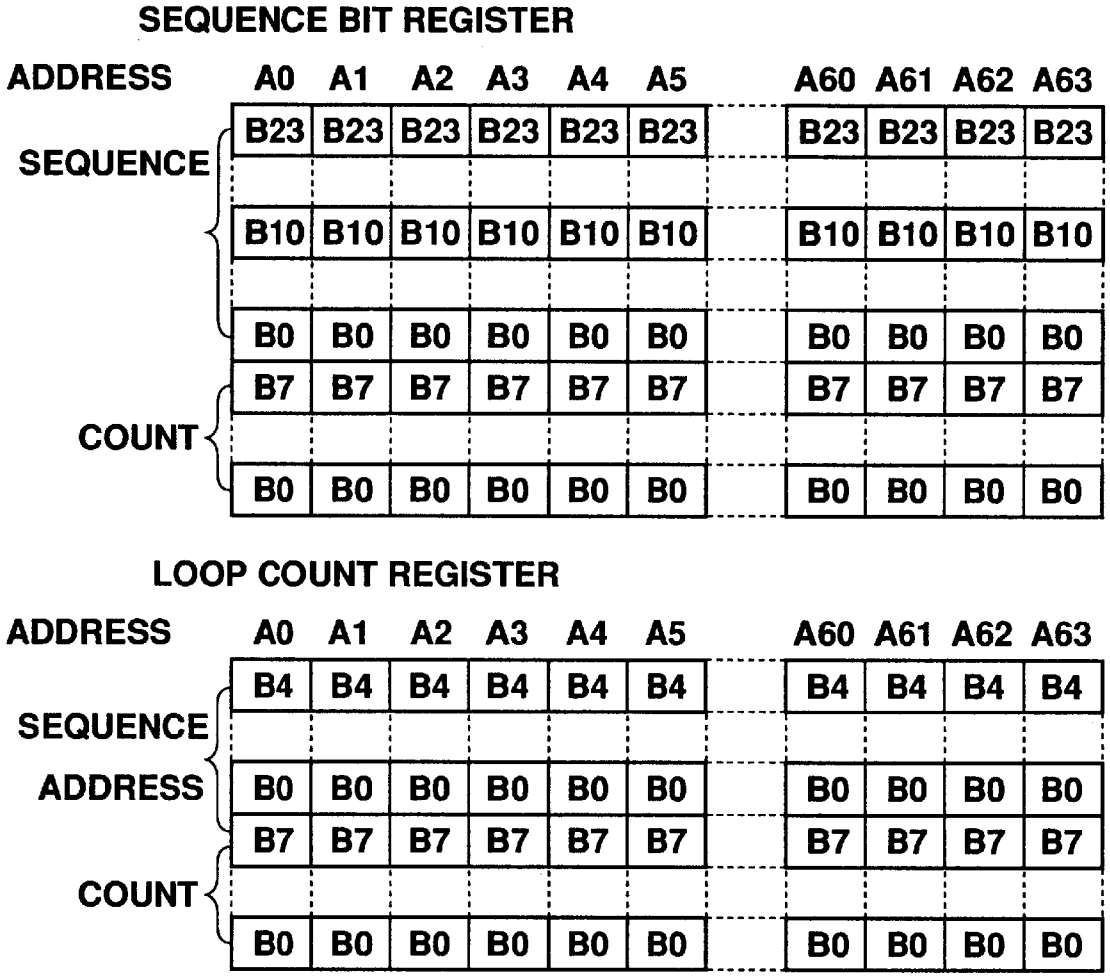
FIG. 4 shows a structure of a sequence bit register and a loop count register.

The operation of the sequencer will be described next. The sequencer 20 internally contains a sequence bit register 20*a* and a loop counter register 20*b*. Their structures are shown in FIG. 4.

The sequence bit register 20*a* stores the sequence for the drive signal and its period. Sequence bits B0 to B23 of each address A0 to A63 indicate values for output, and these values are, for example, commands for the drive voltage for the common electrode. Counter bits B0 to B7 indicate the output periods of the sequence bits. The counter bits can be, for example, the number of clocks of a system clock.

The loop count register 20*b* stores the address of the sequence bit register and the number of sequence outputs. Sequence address bits B0 to B4 of each address A0 to A63 indicate the address of the sequence bit register 20*a*, and the sequence output is performed according to this address setting. Furthermore, the counter bits B0 to B7 indicate the number of loops of the sequence to be performed at the specified address.

Figure 5:
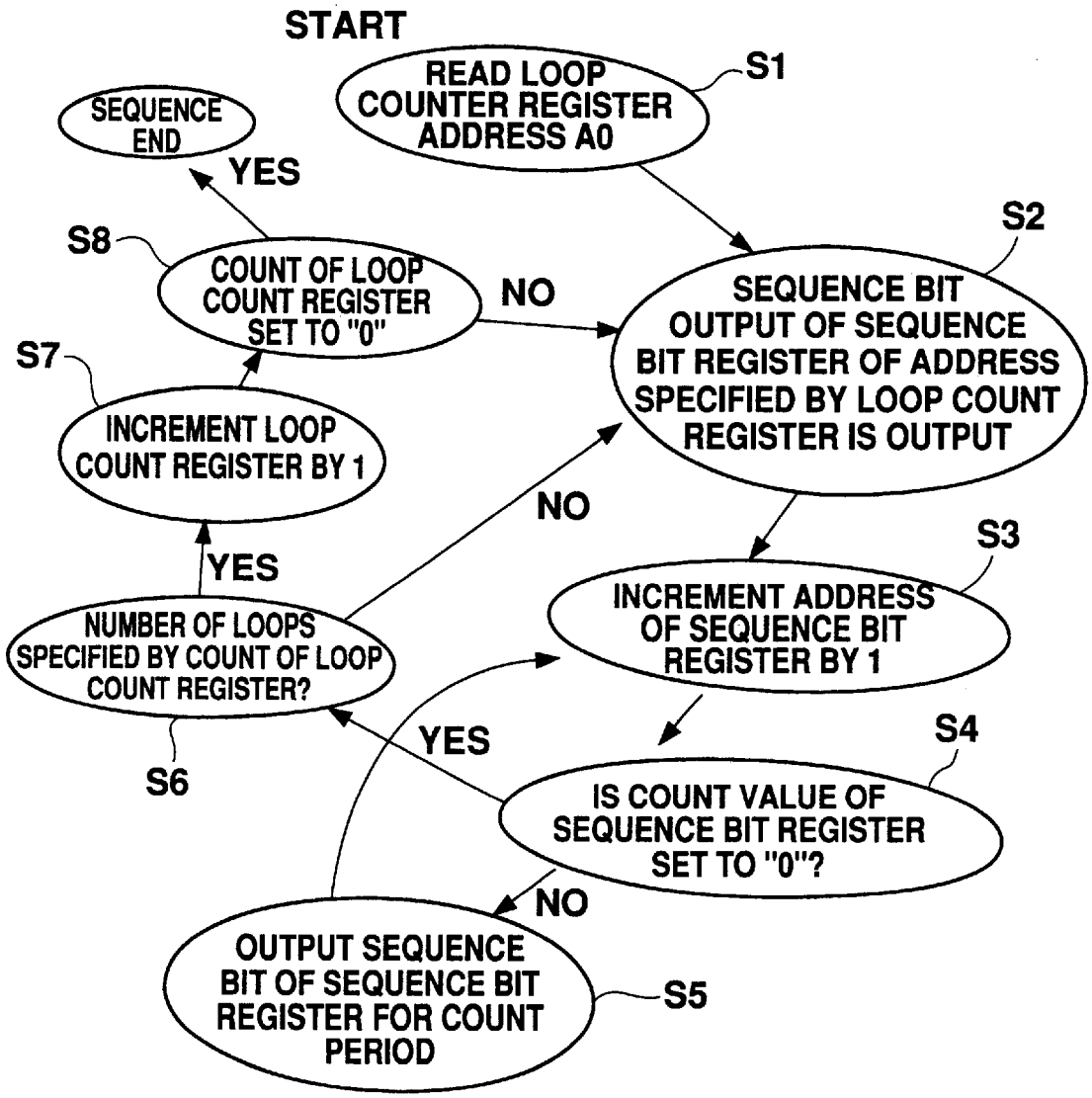
FIG. 5 shows a sequence operation.

The operation at the sequencer 20 will be described here with reference to FIG. 5. The sequencer 20 first reads (S1) the top address A0 of the loop count register 20*b*. Next, the sequence bit of the sequence bit register 20*a* at the address specified by the sequence address of the loop count register is output for the period specified by the counter bit (S2). When the output of S2 terminates, the address of the sequence bit register 20*a* is incremented by 1 (A1 follows A0) (S3). It is then judged whether the count value of the sequence bit register 20*a* has been set to 0 (S4).

If the count value of the sequence register 20*a* is a specific value (in this case 0), the setting is made to signify the termination of the successive output of the sequence in the sequence register 20*a*.

If the result of the judgment in S4 is NO, the sequence bit of the next address (address in the previous process incremented by 1) of the sequence bit register 20*a* is output for the count period (S5). When this is terminated, the operation returns to S3, which increments the sequence bit register 20*a* by one. The output of the sequence stored in the sequence bit register 20*a* is repeated, and the output of the sequence in the sequence bit register 20*a* is repeated until the count value of the sequence bit register 20*a* reaches 0. A count value other than 0 signifies that some type of output is to be performed while a count value of 0 signifies that the output is not to be performed or the termination of the sequence.

Then, when the count value of the sequence bit register 20*a* becomes 0 and the result of S4 is YES, the operation returns to the loop count register 20*b* where it is judged whether the specified number of loops of the count has been performed (S6). If the specified number of loops has not been performed, the operation returns to S2 where the sequence of the sequence bit register of the address specified by the loop count register 20*b* at the time is output.

In this manner, if the process specified by one address of the loop count register 20*b* terminates (termination of the specified number of loops of the count of the loop count register 20*b*) and the result of S6 is YES, the address of the loop count register 20*b* is incremented by 1 (S7). It is then judged whether the count value of the loop count register 20*b* is 0 (S8).

If the count value is 0, this signifies that the corresponding sequence is not to be performed. Therefore, not performing the output signifies the termination of the sequence so in this case the sequence is terminated. On the other hand, if the count value of the loop count register 20*b* is not 0, the operation returns to S2 and the sequence bit of the sequence bit register of the address specified by the loop count register 20*b* is output for the count period.

In this manner, the output of the common pulse to the common electrode is performed. Controlling the voltage of the individual electrode on the basis of the display data in the period in which the output of this common pulse is performed enables the light emission of each display cell to be controlled.

Figure 6:
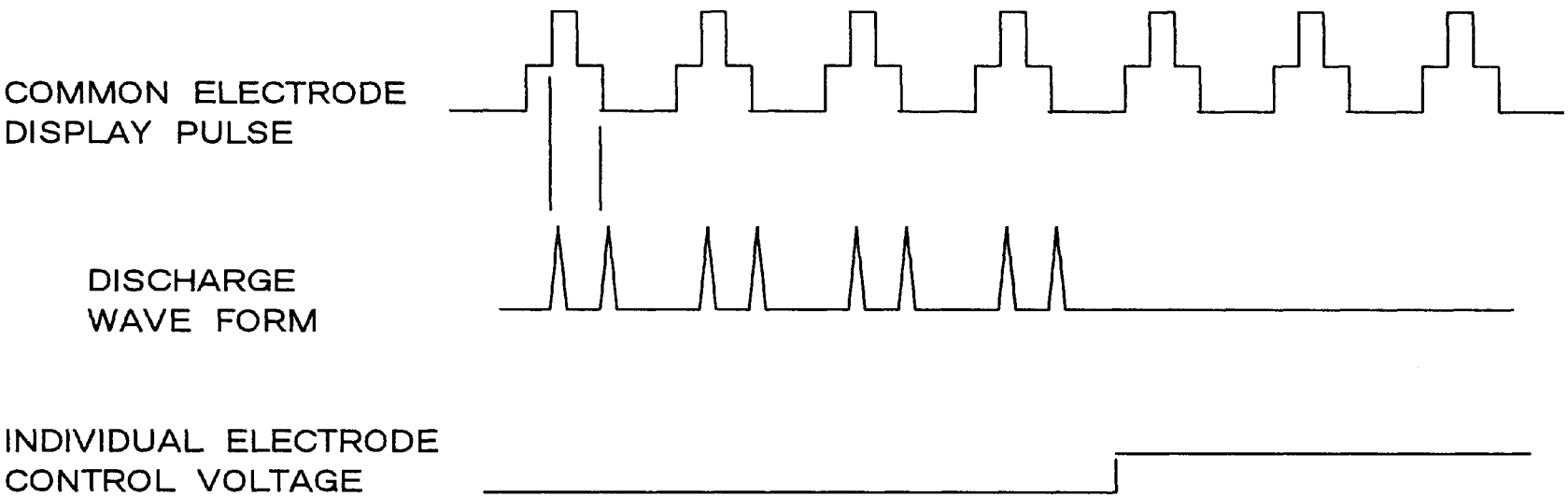
FIG. 6 shows a discharge sequence.

For example, as shown in FIG. 6, the display pulse in which the voltage from the common electrode rises and falls in two levels is repetitively output and the control voltage at the individual electrode is individually controlled. As a result, a discharge occurs when the control voltage at the individual electrode is set low, and the discharge is inhibited when the control voltage is changed to high. This achieves luminance control by controlling the light emission time or number of discharges.

Next, in addition to the synchronization sequence for synchronizing to the vertical synchronizing signal to be executed every time in each frame so that the display pulse is applied onto the common electrode as a sequence, the sequencer of this embodiment also contains an insertion sequence for inserting the reset pulse only into a predetermined frame. The execution of this insertion sequence is identical to the execution of the above-mentioned sequence except that the output differs.

Figure 7:
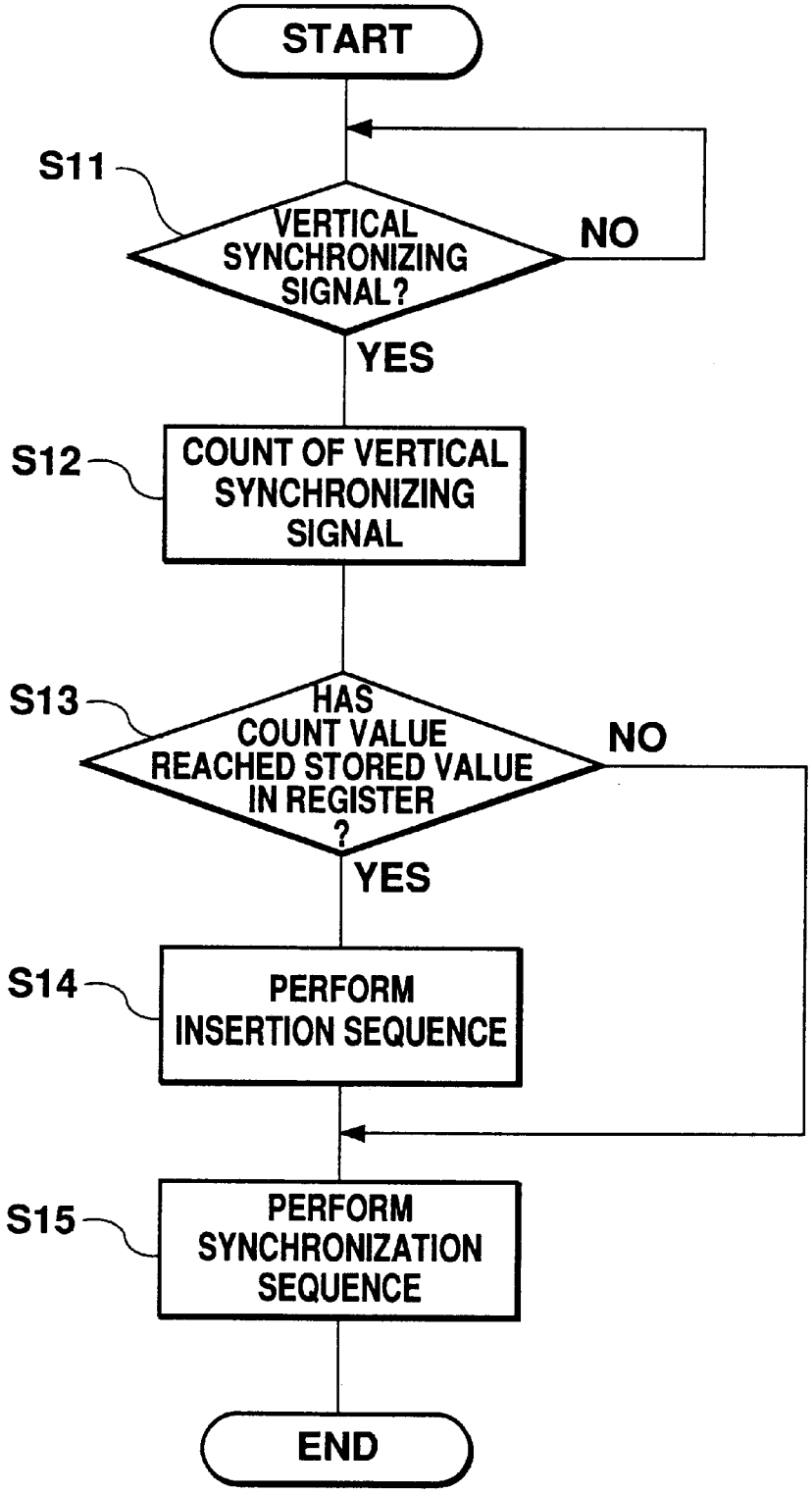
FIG. 7 is a flowchart showing insertion of an insertion sequence.

This insertion sequence is inserted before the actual display (discharge due to display pulses) begins. This is described with reference to FIG. 7. It is first judged whether the vertical synchronizing signal has arrived (S11). Although this vertical synchronizing signal signifies the termination of the vertical retrace period, it may also signify the start or middle of the vertical retrace period.

The vertical synchronizing signal is counted (S12) when it arrives. This is then compared with the value stored in the register (S13). For example, if this sequence is to be performed every three frames, a "3" is stored in the register. Then, if the count is greater than or equal to the stored value of the register, the insertion sequence is performed (S14).

If the operation of the insertion sequence terminates or if the count value in S13 has not reached the value stored in the register, the synchronization sequence is performed (S15). As a result, according to the value stored in the register, the insertion sequence can be executed at every predetermined frame. It is preferable to execute this insertion sequence prior to the start of the synchronization sequence that is to be performed each time.

Changing the stored value in the register enables the timing for the execution of the insertion sequence to be arbitrarily set, and enables the insertion sequence to be executed as desired in the sequencer 20.

It is preferable to insert the reset pulse here as the insertion sequence. The reset pulse applies a negative voltage to the common electrode so that wall charges can be erased.

When the power is turned on, the discharge may not occur normally due to insufficient voltage and wall charges may collect in the display cell. The wall charges may remain even with continuous discharges. In this case, applying a reset pulse having a polarity opposite to that of the display pulse to the common electrode causes a discharge to erase any wall charges that are present so that subsequent discharges can be performed normally.

Figure 8:
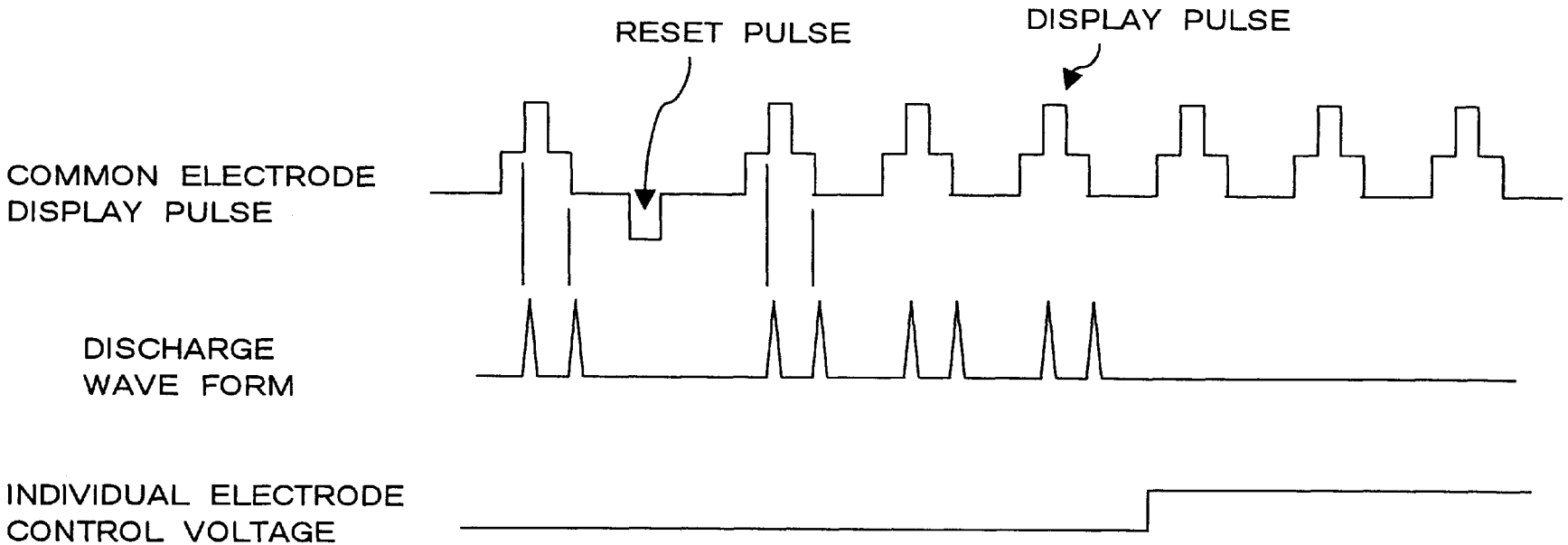
FIG. 8 shows the insertion of a reset pulse in a stable state.
Figure 9:
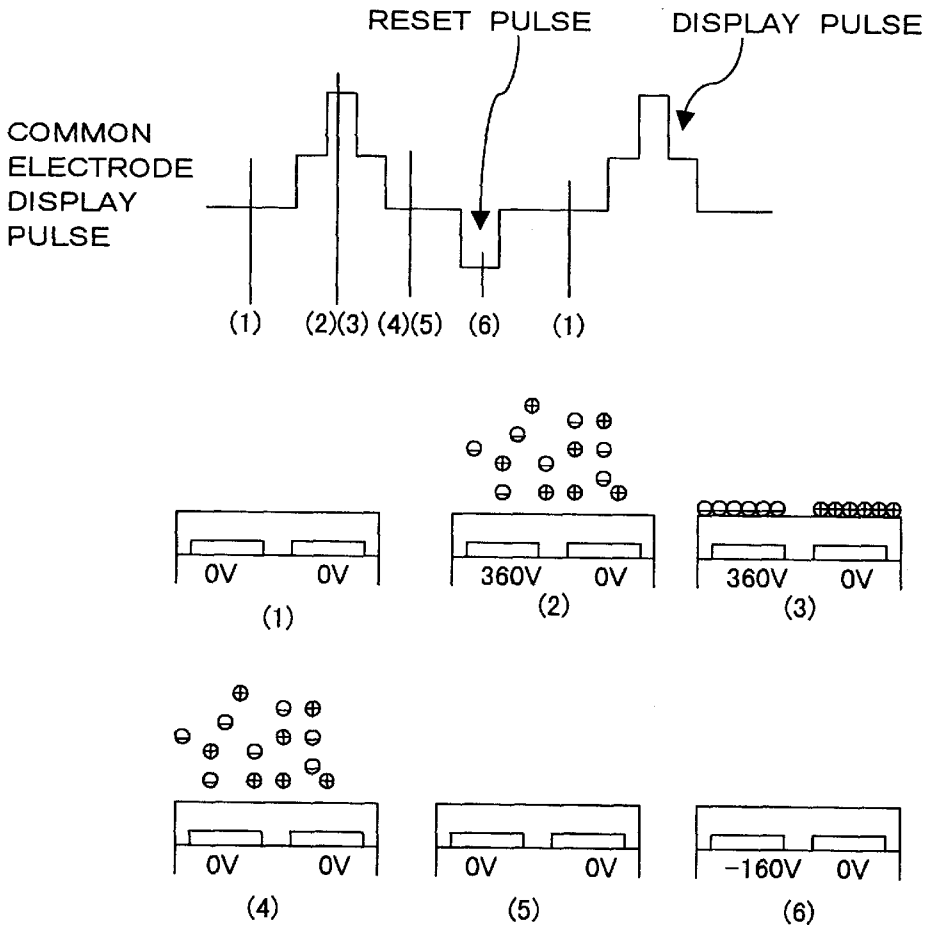
FIG. 9 shows a discharge state in the stable state.
Figure 10:
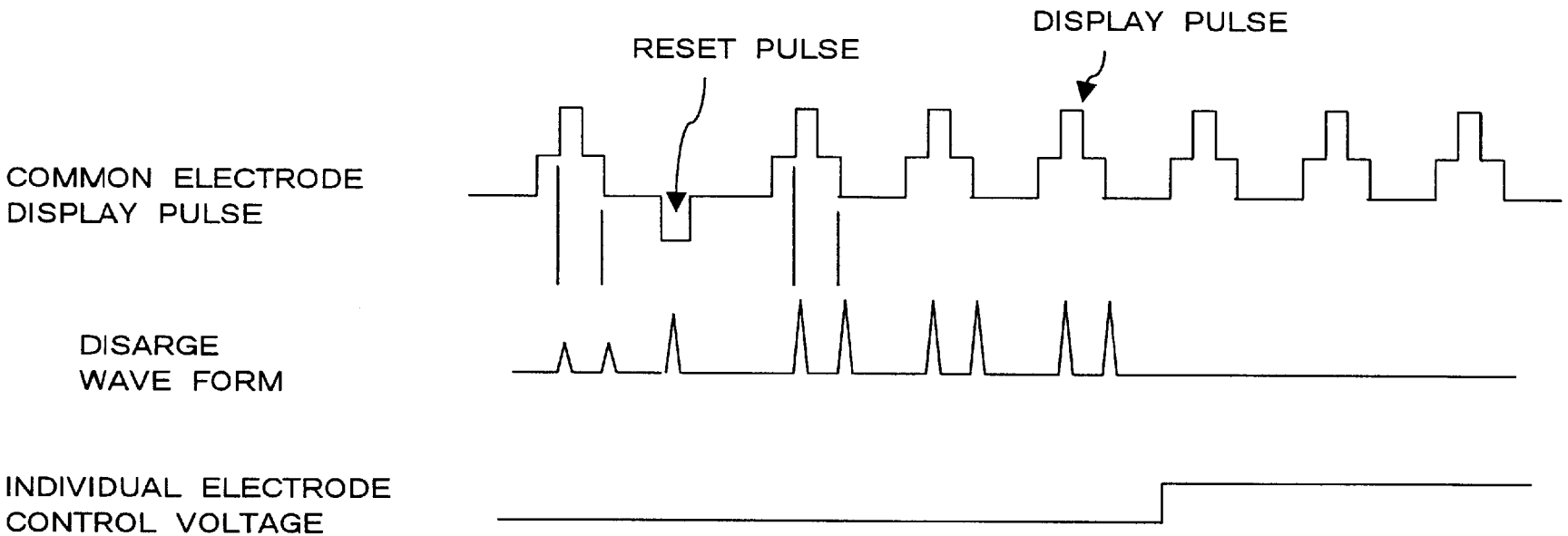
FIG. 10 shows the insertion of the reset pulse in an unstable state.
Figure 11:
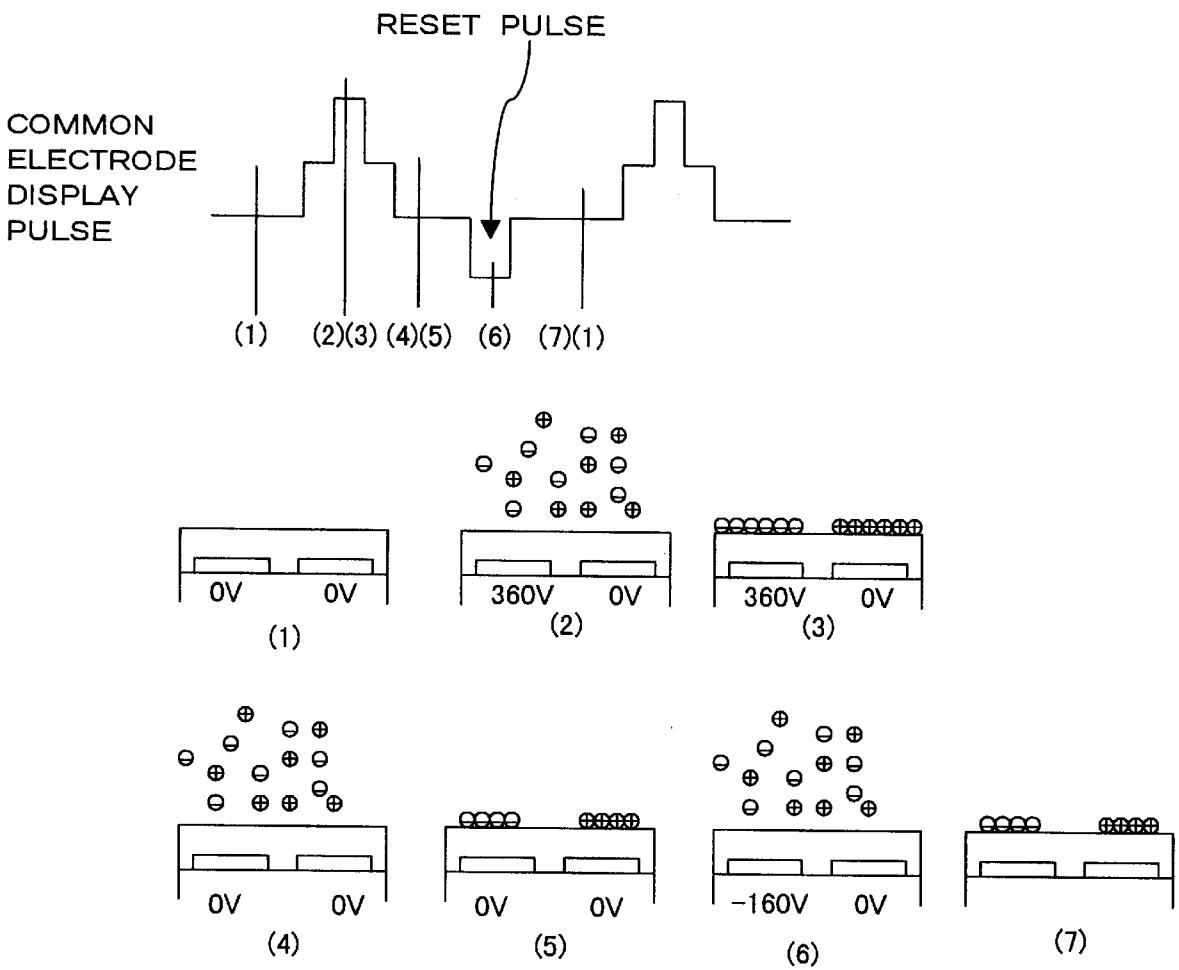
FIG. 11 shows a discharge state in the unstable state.

For example, when the reset pulse has been inserted as the insertion sequence, a negative reset pulse is inserted between display pulses as shown in FIGS. 8 and 9. If a stable discharge occurred with the previous display pulse, the reset pulse does not cause a discharge. On the other hand, if an unstable discharge occurred with the previous display pulse as shown in FIGS. 10 and 11, wall charges remain. Inserting a reset pulse then causes a discharge to erase the wall charges so that a stable discharge subsequently occurs. With regard to the insertion sequence, the execution method in the sequence 20 is identical to that for the above-mentioned synchronization sequence. The reset pulse should be inserted during the normal vertical synchronizing period or sometime prior to the start of the subsequent display.

Particularly, in this embodiment, the reset pulse was designed to have a polarity opposite to that of the display pulse. It is then simply a matter of controlling only the sequence for the driving of the common electrode, and this can be performed under control of the sequencer 20.

Furthermore, in this embodiment, a pulse having a polarity opposite to that of the display pulse is employed for the reset pulse, and is applied to the common electrode. This obviates the need to apply a separate voltage for wall charge erasure to the individual electrode. Therefore, it is not necessary to apply high voltages in the drive circuit for the individual electrode and the frequency of applying voltages to the individual electrode can be low. Namely, when applying the pulse for initialization to the individual electrode to erase wall charges, a considerably high voltage is necessary, and the driving frequency for the individual electrode rises when this pulse is inserted for initialization. However, since the individual electrode changes state only once in one frame in this embodiment, the rise in driving frequency for the individual electrode can be suppressed.

Figure 12:
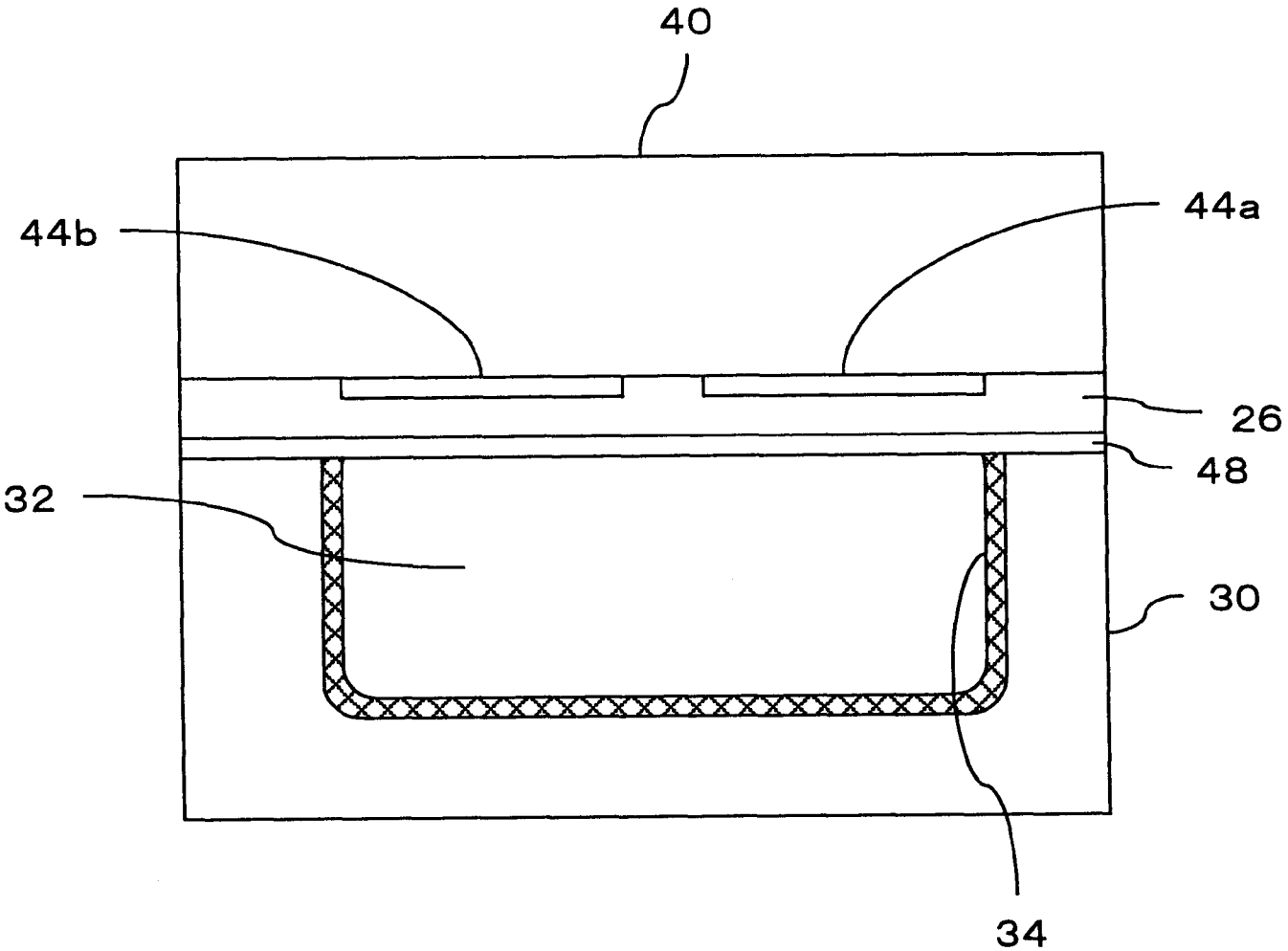
FIG. 12 shows a structure of a display cell.

FIG. 12 shows the structure of one display cell (one color) in a display panel of the embodiment. On a rear side of the display panel there is provided a back glass plate 30. On the inner surface of a recess 32 formed in the back glass plate 30 there is formed a fluorescent layer 34. On a rear side (side facing the back glass plate 30) of a front glass plate 40 there are disposed a pair of transparent electrodes 44*a* and 44*b*. A dielectric layer 46 is formed so as to cover them, and a protective film 48 is further formed. Therefore, the protective film 48, which is usually formed from MgO, faces the recess 32. A positive display pulse is applied to the common electrode and the individual electrode is maintained at a sufficiently low voltage (for example 0 V) so that a discharge occurs at a part close to the protective film within the recess 32. A positive voltage is applied to the individual electrode so that the voltage value between the individual electrode and common electrode drops and the discharge ceases to occur.

The control voltage in the individual electrode is controlled by the above-mentioned display data and the drive of the common electrode is controlled by the output from the sequencer 20.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A display control circuit for controlling, on the basis of luminance data that is input, a gas discharge of a display panel comprising an individual electrode disposed in each of a plurality of display cells disposed in a matrix configuration and a common electrode disposed in common with said plurality of display cells comprising:

a sequence counter for counting the number of display pulses to be supplied to the common electrode;

a lookup table for outputting an assumed luminance value corresponding to the counted number of display pulses addressed by the count value of the sequence counter; and a comparator for comparing the assumed luminance data from the lookup table with luminance data that is input;

whereby an output of the comparator controls a period of applying control voltage to the individual electrode of one display cell.

2. The display control circuit according to claim 1 wherein one said comparator is provided to correspond to one display cell.

3. The display control circuit according to claim 1 wherein said lookup table has contents that can be rewritten.

4. The display control circuit according to claim 1 wherein said lookup table stores differential data and obtains an assumed luminance value by sequentially summing the differential data that is output according to the count value of the sequence counter.

5. The display control circuit for display panel according to claim 1 comprising:

a correction data table for storing correction data regarding each display cell;

whereby correction data corresponding to luminance data for each display cell that is input is read out from the correction data table for correction and the corrected luminance data is supplied to a comparator.

* * * * *